US008578850B2

(12) United States Patent
Westhof et al.

(10) Patent No.: US 8,578,850 B2
(45) Date of Patent: Nov. 12, 2013

(54) DEVICE AND METHOD FOR SETTING AT LEAST TWO CYLINDERS OF A PRINTING MACHINE AGAINST EACH OTHER

(75) Inventors: Frank Westhof, Recke (DE); Uwe Hoewelmeyer, Ibbenbueren (DE); Manfred Loddenkoetter, Ibbenbueren (DE); Rainer Ehrenberg, Hashbergen (DE); Martin Kruempelmann, Lengerich (DE); Frank Gunschera, Osnabrueck (DE)

(73) Assignee: Windmoeller & Hoelscher KG (DE)

( * ) Notice: Subject to any disclaimer, the term of this patent is extended or adjusted under 35 U.S.C. 154(b) by 169 days.

(21) Appl. No.: 13/376,957

(22) PCT Filed: Jun. 7, 2010

(86) PCT No.: PCT/EP2010/003397

§ 371 (c)(1),
(2), (4) Date: Dec. 8, 2011

(87) PCT Pub. No.: WO2010/142405

PCT Pub. Date: Dec. 16, 2010

(65) Prior Publication Data

US 2012/0079954 A1 Apr. 5, 2012

(30) Foreign Application Priority Data

Jun. 10, 2009 (DE) ..... 10 2009 025 053

(51) Int. Cl.

| | |
|---|---|
| ***B41F 13/24*** | (2006.01) |
| ***B41F 5/18*** | (2006.01) |
| ***B41F 5/00*** | (2006.01) |
| ***B41L 3/02*** | (2006.01) |

(52) U.S. Cl.

USPC ..... 101/247; 101/185; 101/216; 101/486

(58) Field of Classification Search

CPC ..... B41F 5/24; B41F 13/38
USPC ..... 101/485, 486, 477, 182, 184, 185, 216, 101/218, 247

See application file for complete search history.

(56) References Cited

U.S. PATENT DOCUMENTS

| | | | | |
|---|---|---|---|---|
| 4,677,360 | A * | 6/1987 | Garces | 318/803 |
| 6,220,162 | B1 | 4/2001 | Kolbe et al. | |

(Continued)

FOREIGN PATENT DOCUMENTS

| | | |
|---|---|---|
| EP | 0718101 | 6/1996 |
| EP | 0990520 | 4/2000 |

(Continued)

OTHER PUBLICATIONS

International Search Report for PCT/EP2010/003397, Enlgish Translation attached to original, Both completed by the European Patent Office on Dec. 7, 2010, All together 5 Pages.

*Primary Examiner* — Ren Yan
*Assistant Examiner* — Blake A Tankersley
(74) *Attorney, Agent, or Firm* — Brooks Kushman P.C.

(57) ABSTRACT

A printing machine with at least one inking unit which has at least two cylinders which are set against each other during the printing operation and can be rotated by at least one drive. The printing machine is provided with sensors for recording parameters of the rotary motion of the cylinders such as the torque and speed. A setting mechanism is provided for setting the at least two cylinders against each other in radial direction. The control unit is configured to trigger the setting mechanism to set the at least two cylinders against each other. The at least two cylinders are brought to different circumferential velocities and set against each other. The relative position of the two cylinders is recorded or maintained when at least one parameter of the rotary motion of the at least two cylinders exceeds a threshold value.

10 Claims, 5 Drawing Sheets

(56) References Cited

U.S. PATENT DOCUMENTS

Figure 1:
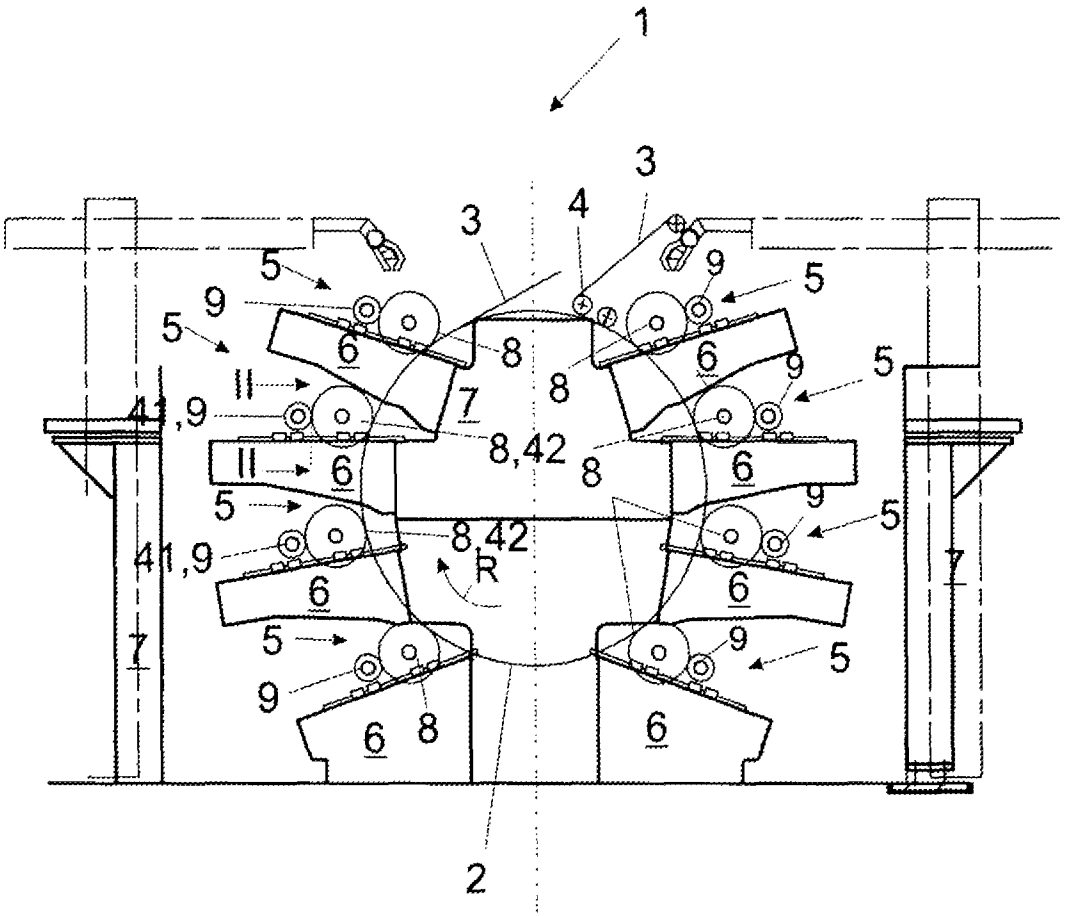

| | | | | |
|---|---|---|---|---|
| 6,634,297 | B2 | 10/2003 | Poetter et al. | |
| 2007/0095227 | A1 * | 5/2007 | Belbey et al. | 101/232 |

FOREIGN PATENT DOCUMENTS

| | | |
|---|---|---|
| EP | 1018426 | 7/2000 |
| EP | 1249346 | 10/2002 |

* cited by examiner

DEVICE AND METHOD FOR SETTING AT LEAST TWO CYLINDERS OF A PRINTING MACHINE AGAINST EACH OTHER

CROSS-REFERENCE TO RELATED APPLICATION

This application is the U.S. national phase of PCT Appln. No. PCT/EP2010/003397 filed Jun. 7, 2010 which claims priority to German application DE 10 2009 025 053.0 filed Jun. 10, 2009, the disclosures of which are incorporated in their entirety by reference herein.

The invention relates to a device for setting at least two cylinders of a printing machine against each other in accordance with the preamble of claim 1 and to an associated method in accordance with the preamble of claim 3.

In the inking units of rotary printing machines, a multiplicity of cylinders are frequently arranged which can be set with respect to their adjacent cylinders at a spacing from one another. For example, various flexographic printing machines have a plurality of inking units which are together arranged on a central back pressure cylinder. For their part, the inking units comprise at least two further cylinders, an impression cylinder and an applicator roll.

In order to process print jobs, it is necessary to set the cylinders present in the inking unit against each other at a defined spacing and/or with a defined force, in order to achieve an optimum ink transfer onto the printing material to be printed.

Patent application EP 1 018 426 A1 discloses a flexographic printing machine, on which an automatic method for setting an impression cylinder, an applicator roll and a back pressure cylinder against each other can be carried out. First of all, the impression cylinder is set in slow rotation with the aid of the drive motor. Subsequently, the nonrotating applicator roll is moved slowly in its radial direction against the impression cylinder. As soon as contact takes place between the impression cylinder and the applicator roll, a torque change occurs in the drive train of the impression cylinder which is detected by a rotary encoder (of the drive train). The position which the applicator roll has reached at this moment is stored by the control unit of the printing machine as zero position for the applicator roll. Subsequently, the impression cylinder which continues to rotate is moved against the back pressure cylinder until a further torque change occurs in its drive train. The position of the impression cylinder is stored in the control unit as zero position for the impression cylinder. The path which the impression cylinder has moved until contact with the back pressure cylinder is added to the zero position of the applicator roll.

The impression cylinders frequently consist of a cylinder mandrel which optionally carries a cylinder sleeve, on which in turn a plate is fastened. However, the plate can also be fastened directly on a solid cylinder. Here, the plate carries the elevated regions which produce the printing image. The plates are replaced after every job change. The different plates also as a rule have different thicknesses. The zero position of the cylinders therefore has to be redetermined again after every job change.

The throwing-on method according to EP 1 018 426 A1 has disadvantages, however, since the forces which act on the cylinder surface in the case of contact between the cylinders are very high. Tests have shown that, after this throwing-on method, the impression cylinders already show damage after a few automatic throwing-on cycles. In flexographic printing, for example, the elevated regions of the impression cylinder which are usually provided by a plate are damaged during a throwing-on method of this type.

It is therefore the object of the present invention to propose a device and a method for setting cylinders of a printing machine against each other, in which device/method the damage of the impression cylinder is avoided.

According to the invention, this object is achieved by the features of the characterizing parts of claims 1 and 2. According to this, the control unit of the printing machine is set up in such a way that it operates the at least one drive of the cylinders in field weakening mode during the throwing-on operation of said cylinders against each other.

Moreover, at least one of the at least two cylinders has an asynchronous motor as drive, and at least one of the two cylinders has at least one elevation (45) on its circumferential face.

The present invention can advantageously be used in flexographic printing machines. Printing machines of this type have at least one inking unit which comprises at least two cylinders. As has already been mentioned above, said cylinders are an impression cylinder (including plate) and an applicator cylinder which are set against each other and against the back pressure cylinder during printing operation. Modern flexographic printing machines can have up to 10 inking units which are arranged together around a central back pressure cylinder. As a rule, all the cylinders (back pressure cylinder, impression cylinder and applicator roll) are equipped with a dedicated drive. They are frequently electric motors which apply a torque to the cylinder axle, usually without a gear mechanism. DC, three-phase, synchronous or asynchronous motors are conceivable.

The cylinders are mounted rotatably in the inking unit in what are known as bearing blocks. The bearing blocks are usually provided with spindle drives and associated electric motors and can be moved on rails in the radial direction of the cylinders. The cylinders can be set against each other with the aid of the displaceable bearing blocks. The spindle motors of the bearing blocks can be actuated via a control unit of the printing machine. Here, the control unit knows the respective (current) position of the individual bearing blocks, and therefore also the radial position of the cylinders with respect to one another.

In order to set the cylinders against each other before the start of printing, at least one cylinder is set in a rotational movement with the aid of its drive motor. Subsequently, the rotating cylinder is brought into contact with an adjacent cylinder. It does not matter here which cylinder is moved in its radial direction for this purpose. What is important is merely a continuous decrease in the radial relative position of the two cylinders with respect to one another. Radial direction means that the movement direction should contain at least one radial component of the cylinder, with the result that at least partial contact of the circumferential faces of the two cylinders is brought about. Accordingly, nonparallel setting of the two cylinders with respect to one another is also possible. In this case, the axles of the at least two cylinders are oblique with respect to one another during the throwing-on operation.

Sensors are provided in the inking unit, which sensors record the parameters of the rotational movement of the cylinders. As a rule, the parameters will be the torque and/or the rotational speed of the cylinders. If said parameters change, a first contact is produced between the cylinders to be set against each other. The rotary encoder which is assigned to the rotating cylinder can serve as sensor, for example. The rotary encoder is capable of measuring the angular velocity (rotational speed) of a rotational body (of the cylinder in this case). The data of the rotary encoder are transferred to the control unit via a suitable data line. If the diameter of the cylinder is known, the circumferential speed can be calculated from the angular velocity. In the event of the first contact of the two cylinders, a change in the angular velocity of the thrown-on cylinder is detected by the control unit. At this moment, the radial relative movement of the two cylinders with respect to one another is ended. The position which the cylinders have with respect to one another at this instant is stored by the control unit as zero position.

As an alternative, in the event of the first contact of the cylinders, a change in the current which forms the torque and is fed to the drive of the cylinder can be detected by the control unit. As a rule, the current which forms the torque is supplied by what is known as a frequency converter. However, what are known as servos can also be provided for this purpose. In this case, the measuring device which monitors the current which forms torque serves as sensor for the first contact of the cylinders. As a rule, the current which forms torque is monitored by the control unit of the printing machine. In the case of an asynchronous machine, the energizing current (field current) and/or the current which forms torque can be monitored. A multiplicity of other sensors which can measure the parameters of the rotational movement of the cylinders are also conceivable. For example, optical sensors which record the rotational speed of the cylinder are conceivable. Pneumatic sensors or piezoelectric sensors which detect the contact of the cylinders are also conceivable. Some of the sensors of this type which are suitable for the detection of contact of two rotational bodies are disclosed in EP 0 627 309 A1.

In the case of a flexographic printing machine, it is necessary to set more than two cylinders against each other. In this case, it is appropriate first of all to set the impression cylinder and the applicator roll against each other. The zero position determined in this way of the applicator roll is stored in the control unit. It is subsequently advantageous to set the applicator roll away from the impression roll by a defined distance and to set the rotating impression cylinder in the radial direction against the back pressure cylinder according to the same method. The zero position of the impression cylinder is thus determined and likewise stored in the control unit. The difference in distance which the impression cylinder moved with respect to the back pressure cylinder is added to the zero position of the applicator roll. Before the start of printing, a defined pressing travel, what is known as an offset, is added to the zero position. This pressing travel ensures that the cylinders exert an optimum contact pressure against one another and therefore achieve the desired ink transfer on the printing material. This pressing travel advantageously lies between 10 and 100 μm.

In order not to damage the elevated regions of the impression cylinder during the throwing-on process, the control unit reduces the current which forms torque and is fed to the drive of the cylinder, with the result that the drive experiences what is known as field weakening. For this purpose, the control device will as a rule actuate a power actuator, such as a frequency converter, which is assigned to the relevant drive. This current will preferably be what is known as the field current (for example, in the case of an asynchronous motor). The magnetic flux in the working region of the motor is thus lowered below the nominal value. A reduction in the torque at the same speed is therefore achieved in the drive. If a rotating cylinder is now set against another cylinder according to the above-described method, the torque and therefore the force which acts on the cylinder surface in the case of the contact of the cylinders are very low. The cylinder surface and, in particular, the elevated regions of the impression cylinder, are not damaged.

Field weakening can be realized both in DC motors and in three phase motors.

However, it is particularly advantageous if at least one of the at least two cylinders has an asynchronous motor as drive. Field weakening is particularly simple to realize in the asynchronous motors. To this end, the field current is simply lowered, as has already been described above.

In order to achieve field weakening in a synchronous motor, an opposing magnetic field has to be applied to the rotor of said synchronous motor. However, this is technically very complicated.

In one particularly preferred refinement of the invention, at least one of the cylinders which are to be set against each other performs a rotational movement, the direction of which changes. It can be advantageous here if the movement changes by turns, that is to say in an alternating manner. However, it can also be advantageous if one movement direction is preferably carried out.

In one advantageous embodiment, at least one of the cylinders comprises an elevation on its circumferential face. This elevation makes the first contact during the throwing-on operation of the at least two cylinders. This means that the elevation is in contact with a cylinder as soon as the sensors detect a change in the parameters of the rotational movement of the cylinders. The elevations are also called microdots. They advantageously have a diameter of from 100 to 400 μm, but preferably a diameter between 150 and 250 μm. The height of the microdots is adapted to the height of the elevated regions (that is to say the plate height). The use of microdots of this type is recommended, for example, during the adjusting of the printing machine.

It is particularly advantageous if the throwing-on operation of the at least two cylinders first of all takes place on one side. In this case, first of all a bearing block of the cylinder to be thrown on is moved in the radial direction against the other cylinder until the control unit detects the first contact between the cylinders. During the first contact, the cylinders are accordingly not parallel to one another. After the control unit has stored the zero position on one side, the cylinder is moved back into the initial position. Subsequently, the other side of the cylinder is moved against the other cylinder and the zero position on the other side is likewise determined and stored. A uniform throwing-on operation (a uniform force in the axial direction of the cylinders) can be achieved in the axial direction by this "determination on both sides of the zero position".

It is particularly advantageous if both of the at least two cylinders rotate during their throwing-on operation. A rotation in opposite directions of the at least two cylinders is particularly advantageous. A small speed difference can be realized with a rotation in the opposite direction, with a different speed of the cylinders. Only a low force is therefore exerted on the elevated regions of the impression cylinder. However, it can also be advantageous if the cylinders have the same rotational direction during the throwing-on operation. This can be advantageous if the parameters change during the throwing-on operation only to such a small extent that the sensors can detect them only with difficulty. An identical rotational direction reinforces the changing parameters during the cylinder throwing-on operation.

One particularly preferred refinement of the invention comprises the speed difference between the at least two cylinders during the throwing-on operation being less than 30 mm/s, but preferably lying between 5 and 10 mm/s.

Further exemplary embodiments of the invention are apparent from the description of the subject matter and the claims.

Figure 2:
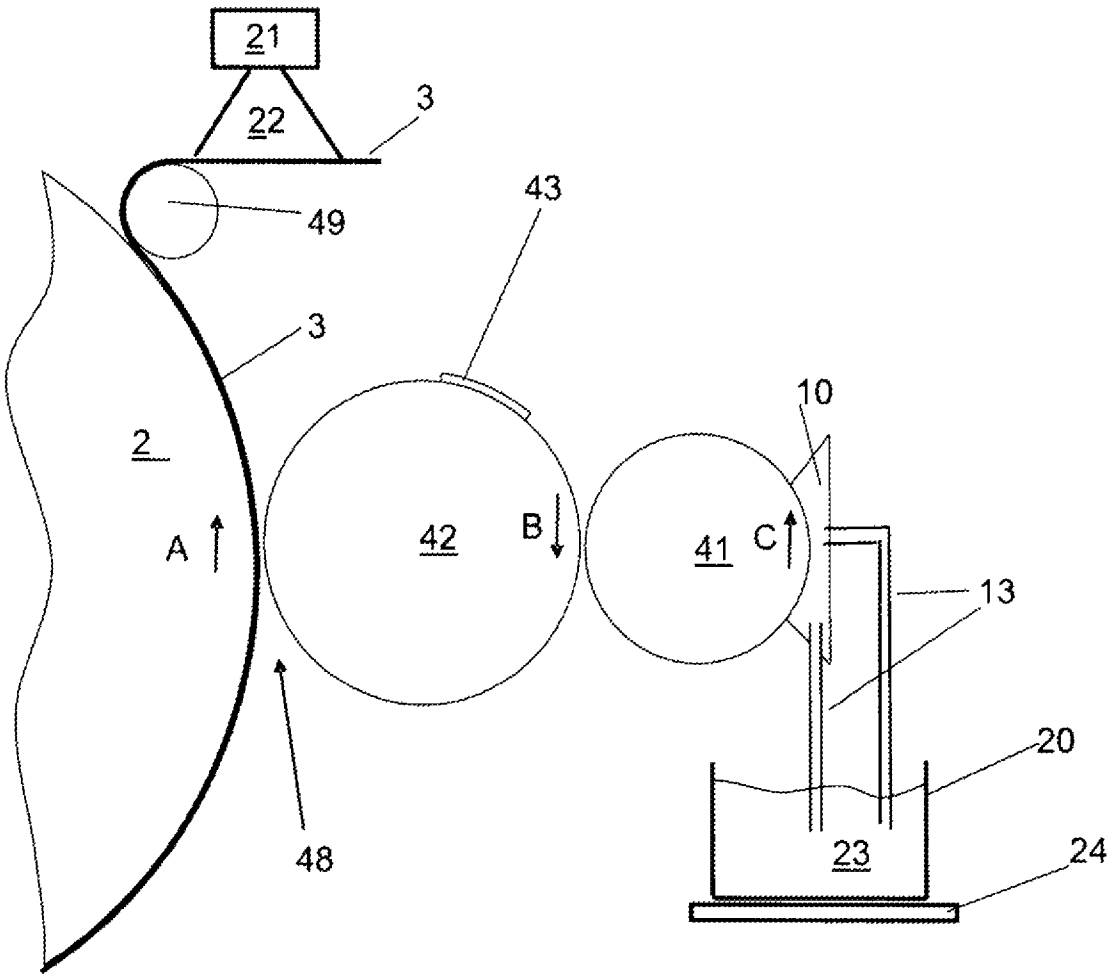
Figure 3:
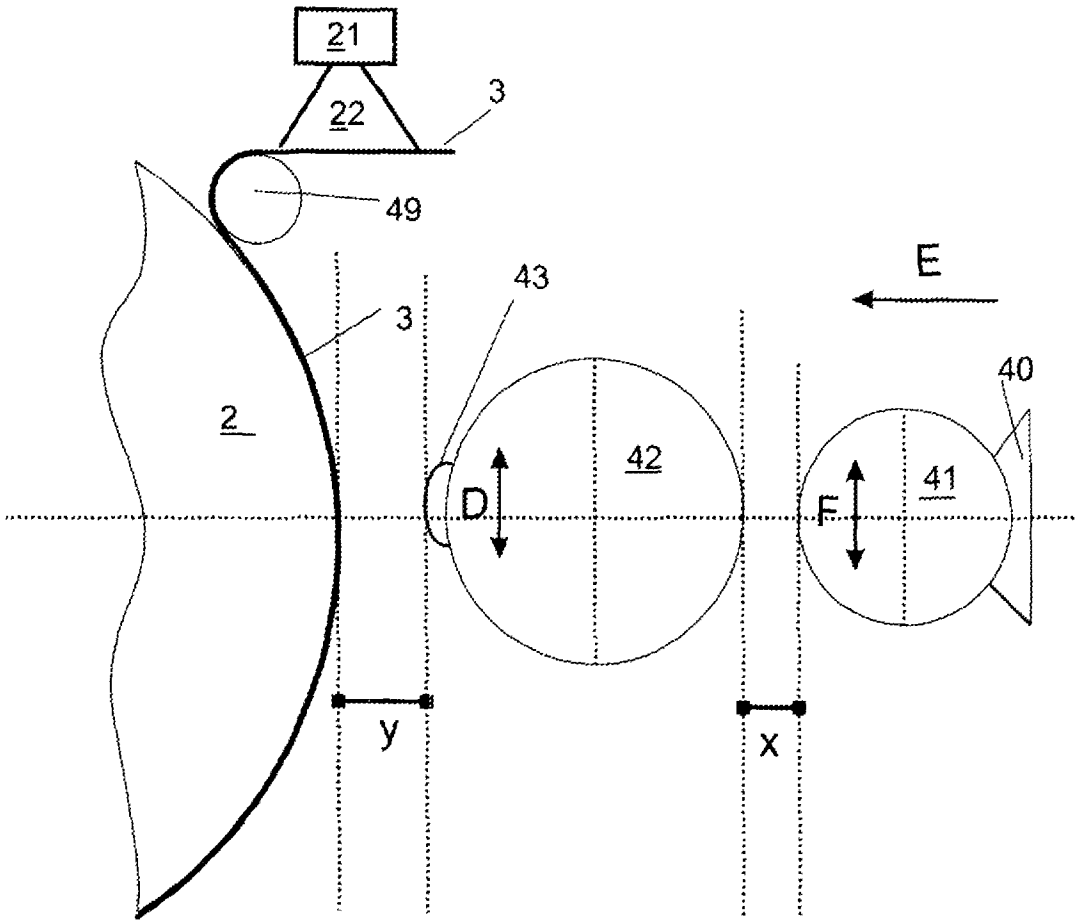
Figure 6:
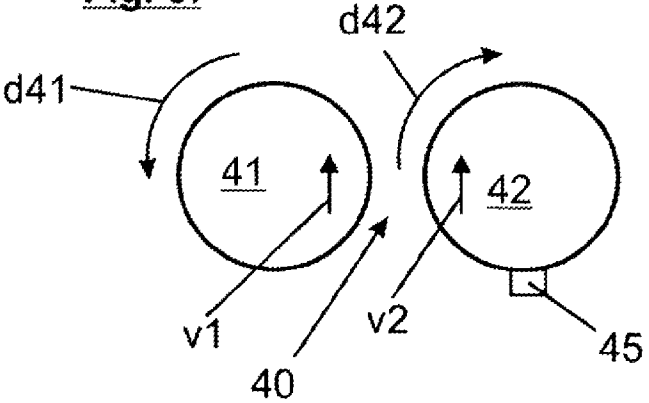
Figure 7:
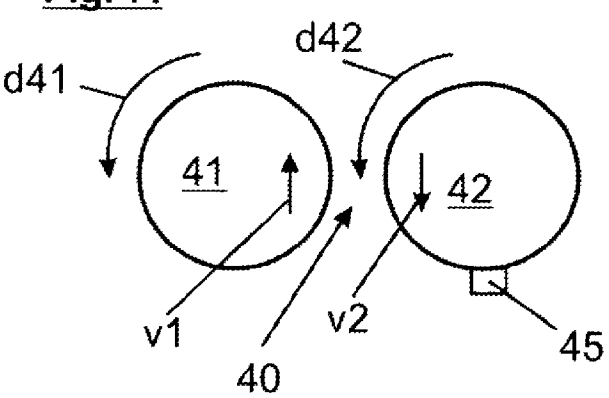
Figure 4:
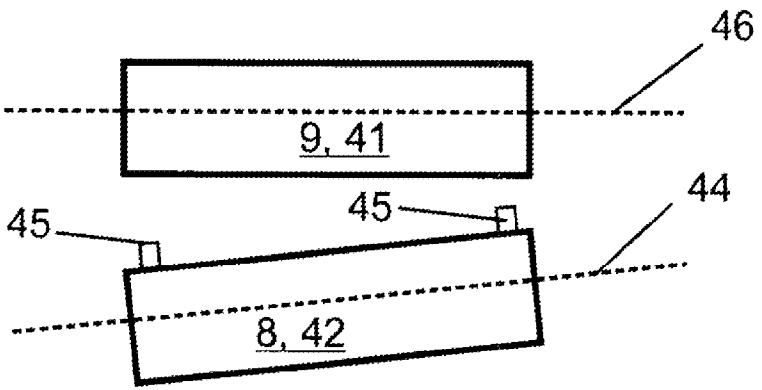
Figure 5:
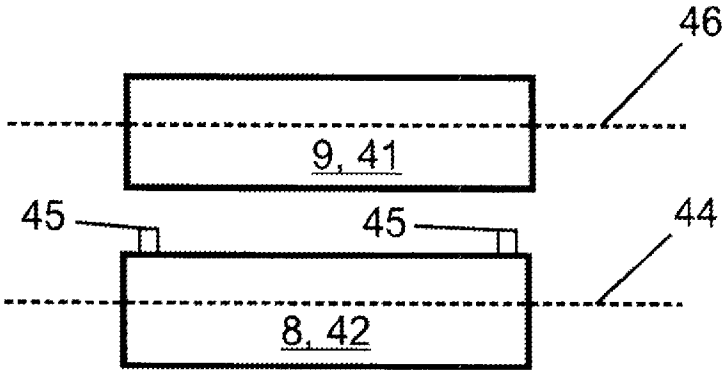
Figure 8:
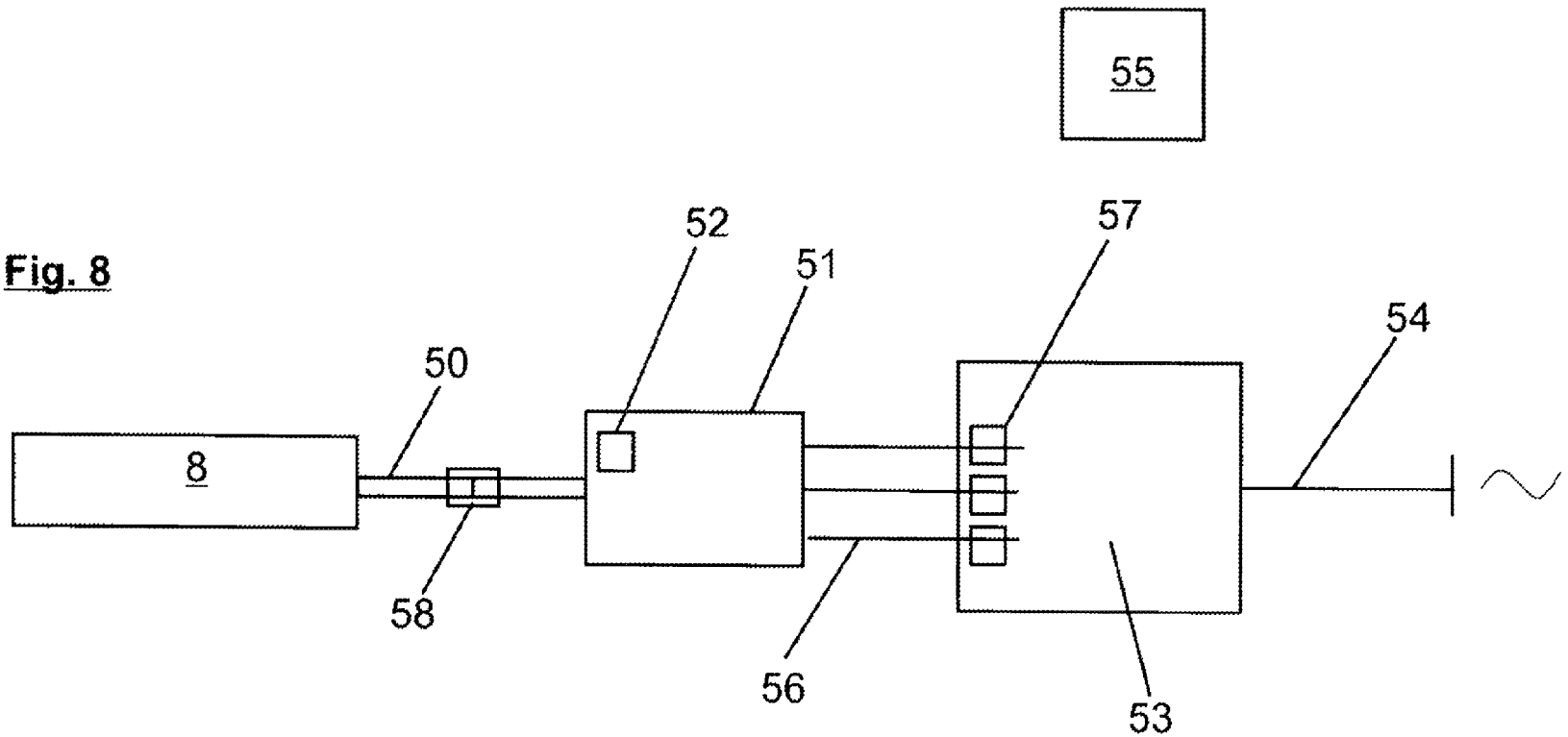

In the individual figures:

FIG. 1 shows a side view of a printing machine,

FIG. 2 shows a side view of an inking unit of a central cylinder flexographic printing machine, FIG. 3 shows a side view of an inking unit of a central cylinder flexographic printing machine, FIG. 4 shows a plan view of the impression cylinder and the applicator roll, FIG. 5 shows a plan view of the impression cylinder and the applicator roll, FIG. 6 shows a side view of the impression cylinder and the applicator roll, FIG. 7 shows a side view of the impression cylinder and the applicator roll, and FIG. 8 shows an outline sketch of one exemplary embodiment of a drive of a printing machine according to the invention.

FIG. 1 shows a printing machine 1 which is a central cylinder flexographic printing machine in the exemplary embodiment which is shown. It therefore comprises a back pressure cylinder 2, on which the printing material 3 is guided. The rotational direction of the back pressure cylinder is shown by the arrow R. In order that the printing material 3 already lies completely on the back pressure cylinder 2 in front of the first impression roll, said printing material 3 is guided by a pressing roll 4.

A plurality of inking units 5, eight in the exemplary embodiment which is shown, are arranged around the back pressure cylinder 2. Each inking unit 5 first of all comprises a bracket 6 which extends away from a central machine frame 7. Each bracket carries the cylinders which are necessary for printing one color. The impression rolls 8 can be set against the back pressure cylinder 2. Engraved rolls 9 are provided to apply the printing ink to the impression rolls 8, which engraved rolls 9 can accordingly be set against the impression rolls 8. The engraved rolls 9 are supplied with the respectively desired printing ink out of the doctor chambers 10 (not shown in FIG. 1). Since, in particular, the impression rolls 8, optionally also the engraved rolls 9, are to be exchanged for such rolls with different diameters or for such rolls with differences in relation to other properties (in engraved rolls, for example, the delivery volume), said rolls 8, 9 are mounted in bearing blocks which can be displaced relative to the back pressure cylinder by means of suitable displacement devices. Said displacement devices can comprise guide rails which are fastened on or to the bracket and which extend away from the back pressure cylinder. Furthermore, the displacement devices comprise drives for displacing the bearing blocks along the guide rails, said drives as a rule having a spindle/spindle nut combination.

Each of said rolls 8, 9 is supplied with a drive torque by components which feed in torque. These are often gearwheels which mesh with in each case one gearwheel which is attached to the roll. Said gearwheels can be driven by a central drive. However, printing machines have also been known for some years which comprise a dedicated drive for each roll 8, 9, which drives drive the respective roll via gearwheels. Gearwheels are dispensed with completely in modern printing machines; the drives drive the cylinders directly.

In order to exchange the rolls, the bearings of the bearing blocks which mount said rolls are configured in such a way that it is possible to remove the rolls. It is advantageous if the bearings remain on the journals of the rolls and parts of the bearing block are folded away, with the result that the rolls can be removed upward. Moreover, the roll is to be decoupled from the drive train, optionally in advance.

The ink transport from an ink reservoir, here the ink bucket 20, to which ink is fed from outside the printing machine, to the printing material 3 can be outlined using FIG. 2.

The ink lines 13 produce the connection between the ink bucket 20 and the doctor chamber 10. Ink 23 is guided to the doctor chamber in one ink line and is guided from the doctor chamber 10 to the bucket 23 in the other line 13. The engraved roll 41 dispenses the ink to the plate 43 of the plate roll 42 which rotates in the direction which is specified by the arrow B. The printing material 3 is printed with the plate while said printing material 3 runs through the press nip 48 which is defined by the plate roll 42 and the back pressure cylinder 2.

The printing material is conveyed further in the rotational direction A of the back pressure cylinder, runs past the guide roll 49, is raised up from the back pressure cylinder 2 and is examined by the optical measuring device 21. The light cone 22 represents the light which is reflected by the printed image.

A weighing device 24 which monitors the weight of the bucket 20 is shown for the purpose of weighing or determining the ink mass or the ink volume of the relevant ink 23 on the printing machine 1.

FIG. 3 shows the cylinders of an inking unit of a flexographic printing machine 1 in a thrown-off position with respect to one another. In order to start a new print job, it is necessary, for example after the replacement of a plate 43, to set the cylinders 2, 41, 42 of an inking unit 5 against each other again. The throwing-on method according to the invention first of all comprises setting the impression cylinder 42 which carries the plate 43 in rotation. The cylinder 42 can be rotated in both directions of the double arrow D. Subsequently, the applicator roll 41 is moved on bearing blocks (not shown here) in the radial direction (in the direction of the arrow E) until a sensor of the inking unit 5 detects the exceeding of at least one parameter of the rotational movement of the cylinder 42. Said parameter can be, for example, a change in the circumferential speed of the cylinder 42, which change can be detected by the rotary encoder via a change in the angular velocity, or else a change in the motor current which the frequency converter feeds to the drive of the cylinder 42.

FIG. 6 shows an opposed rotational direction d41 and d42 of the cylinders 41 and 42. The resulting speed vectors v1 and v2 of the cylinders 41, 42 are in the same direction. The differential speed results from the difference in the speed vectors v1 and v2 and is accordingly small in the press nip 40. A rotational movement in the same direction of the cylinders 41, 42 can be seen in FIG. 7. The speed vectors v1 and v2 are directed in opposite directions. The speed difference is great.

Until contact with the impression cylinder 42, the applicator roll has covered a distance x in the radial direction. The position which the applicator roll assumes during the first contact with the impression cylinder is stored in the control unit of the printing machine. Subsequently, the applicator roll 41 is moved back by a defined distance, for example 1 mm, from the impression cylinder, that is to say counter to the arrow E. As a result, the impression cylinder can rotate freely again. The impression cylinder 42 which continues to rotate is now moved in the direction of the back pressure cylinder (in the direction of the arrow E) until a sensor of the inking unit 5 again detects exceeding of at least one parameter of the rotational movement of the cylinder 42. In the example which is shown in FIG. 3, the impression cylinder 42 has to cover a distance y for this purpose. The current position of the impression cylinder is stored as zero position for said impression cylinder. The distance y (of the impression cylinder) is added to the stored position of the applicator roll and is stored as zero position for the applicator roll.

A sequence which specifies which of the three cylinders (back pressure cylinder, impression cylinder, applicator roll) is set against each other first is inconsequential for the method according to the invention. Thus, for example, first of all the impression cylinder can also be set against the back pressure cylinder and afterward the applicator roll can be set against the impression cylinder. EP 1 249 346 A1 discloses a method for setting a printing image in a flexographic printing machine. The exemplary embodiments of EP 1 249 346 A1 shown in FIG. 2 show in what way or sequence the three involved rolls (back pressure cylinder, impression cylinder, applicator roll) of an inking unit of a flexographic printing machine can be set against each other. These throwing-on exemplary embodiments of EP 1 249 346 A1 and the associated text passages are included in the scope of the present patent application.

During what is known as the press run start of the printing machine, the involved cylinders 41, 42 are moved beyond their zero position in the radial direction E via a defined distance, what is known as the offset. This offset brings about the desired contact force and the desired ink transfer of the cylinders which are involved in the printing process.

FIGS. 4 and 5 in each case show a plan view of the impression cylinder 42 and the applicator roll 41. The impression cylinder 42 thus carries the abovementioned microdots 45. One alternative embodiment of the throwing-on method according to the invention comprises first of all setting a first axial end G of a cylinder 42 against the other cylinder 41 (FIG. 4). In this case, first of all the microdot 45 of the first side G comes into contact with the surface of the roll. In this phase (during the throwing-on operation), the axles 46, 44 of the two cylinders 41, 42 are oblique with respect to one another. The position of the first side G of the cylinder 42 is stored in the control unit as zero position of the first side G of the cylinder. Subsequently, the first side G of the cylinder is moved back again into its original position. The axles 46, 44 of the cylinders are again parallel to one another (FIG. 5). The second axial side H of the cylinder 42 is then set against the second roll 41 in the same way. The position upon contact is stored in the control unit as zero position of the second side H of the cylinder. The cylinders 41, 42 can be set against each other during the press run start using the respective zero position of the first side G and second side H of the cylinder. After an above-described parallel throwing-on operation, this further exemplary embodiment of the throwing-on method according to the invention makes a constant throwing-on pressure of the two cylinders 41, 42 possible over the entire axial contact region of said cylinders 41, 42.

One exemplary embodiment of a drive of a printing machine according to the invention is again shown using FIG. 8. The impression roll 8 receives its torque via the drive train 50 from the asynchronous machine 51.

The drive train 50 is often configured without a gear mechanism and therefore merely as a shaft. In FIG. 8, the drive train 50 has a clutch 58, by way of which the impression roll 8 can be released from the asynchronous machine 51. The rotational speed of the asynchronous machine 51 and/or the shaft can be monitored by way of a rotary encoder 52. Said rotary encoder 52 can be integrated structurally into the motor 51. The asynchronous motor 51 receives the current necessary for its operation via the rotary power lines 56 from the frequency converter 53. It is possible to measure the currents which run through the lines 56 by way of current sensors 57, inter alia. The latter can be integrated into the frequency converter 53. The frequency converter receives its current from a mains 54. The control device is in contact with the rotary encoders 52 and current sensors 57 via lines (not shown). Moreover, it can actuate the frequency converter 53 in such a way that the latter operates the asynchronous motor 51 in field weakening operation. For this purpose, said control device can lower, for example, the energizing current or field current below the nominal value; for example, in the case of a nominal value of from 10 A to 1 A.

As a result of measures of this type, the magnetic flux in the working region of the motor 51 is also lowered below its nominal value.

The abovementioned nominal values, above all the nominal currents here, are as a rule known for the motors used in industry from data sheets.

At the same time as the stated measures in relation to the drive, the control unit 55 can also actuate the throwing-on means and optionally the drive of the second cylinder which is to be set against the impression roll, in such a way that the throwing-on process between the cylinders takes place as described in this document, and that the relative circumferential speed of the two cylinders lies in the desired range.

The control unit can be set up, for example by way of a computer program, for the purpose of carrying out these methods according to the invention automatically.

List of Designations

| | |
|---|---|
| 1 | Printing machine |
| 2 | Back pressure cylinder |
| 3 | Printing material |
| 4 | Pressing roll |
| 5 | Inking unit |
| 6 | Bracket |
| 7 | Machine frame |
| 8 | Impression roll |
| 9 | Engraved rolls |
| 10 | Doctor chamber |
| 11 | |
| 12 | |
| 13 | Ink lines |
| 14 | |
| 15 | |
| 16 | |
| 17 | |
| 18 | |
| 19 | |
| 20 | Ink bucket |
| 21 | Measuring device |
| 22 | Light cone |
| 23 | Ink |
| 24 | Weighing device |
| 25 | |
| 26 | |
| 27 | |
| 40 | Press nip |
| 41 | Applicator roll |
| 42 | Impression cylinder |
| 43 | Plate |
| 44 | Axle |
| 45 | Microdot |
| 46 | Axle |
| 49 | Guide roll |
| 50 | Drive train |
| 51 | Asynchronous motor |
| 52 | Rotary encoder |
| 53 | Frequency converter |
| 54 | Mains |
| 55 | Control device |
| 56 | Rotary power lines |
| 57 | Current sensors |
| 58 | Clutch |
| A | Rotational direction |
| B | Rotational direction |
| C | Rotational direction |
| D | Double arrow |
| E | Arrow |

-continued

| List of Designations | |
|---|---|
| F | Double arrow |
| G | First side of the cylinder |
| H | Second side of the cylinder |
| R | Rotational direction |
| X | Distance |
| Y | Distance |
| d41 | Rotational direction of the cylinder 41 |
| d42 | Rotational direction of the cylinder 42 |

The invention claimed is:

1. A printing machine having at least one inking unit, the printing machine comprising:

at least two cylinders which are set against each other during printing operation, to be rotated with the aid of at least one drive;

sensors by way of which the rotational movement of the cylinders may be recorded;

at least one actuator, by way of which the at least two cylinders can be set against each other in their radial directions; and a control unit which sets a throwing-on position of the at least two cylinders by inducing a different circumferential speed between the at least two cylinders, setting the at least two cylinders against each other by way of the at least one actuator, and recording or maintaining the relative position of the at least two cylinders with respect to each other in response to at least one parameter of the rotational movement of the at least two cylinders exceeding a limiting value;

wherein the control unit operates the at least one drive in a field weakening mode during the setting of the throwing-on position, at least one of the at least two cylinders has an asynchronous motor as the at least one drive, and at least one of the at least two cylinders has at least one elevation on its circumferential face.

2. A method of a throwing-on operation for optimizing the radial relative position of at least two adjacent cylinders of an inking unit of a printing machine, which cylinders are driven by at least one asynchronous motor, and at least one cylinder has at least one elevation on its circumferential face, the method of the throwing-on operation comprising:

inducing a different circumferential speed between the at least two cylinders which are first of all set apart from each other;

setting the cylinders against each other;

recording the rotational movement of the cylinders;

recording the relative position of the at least two cylinders with respect to one another in response to at least one parameter of the rotational movement of the at least two cylinders exceeding a limiting value; and operating the at least one asynchronous motor in a field weakening mode during the throwing-on operation.

3. The method as claimed in claim 2, wherein, during the throwing-on operation, the rotational movement of at least one of the cylinders changes its direction.

4. The method as claimed in claim 2, wherein the relative position of the at least two cylinders is recorded on a first axial side of the cylinders and then on the other side of the cylinders.

5. The method as claimed in claim 2, wherein the axles of the at least two cylinders are oblique with respect to one another during the throwing-on operation.

6. The method as claimed in claim 2, wherein a circumferential face of at least one of the cylinders has in each case at least one elevation at its two axial ends.

7. The method as claimed in claim 2, wherein the speed difference between the at least two cylinders during the throwing-on operation is less than 30 mm/s.

8. The method as claimed in claim 2, wherein the speed difference between the at least two cylinders during the throwing-on operation lies between 5 and 10 mm/s.

9. The method as claimed in claim 2, wherein both of the at least two cylinders rotate during their throwing-on operation.

10. The method as claimed in claim 2, wherein, during the throwing-on operation, the cylinders have a rotational direction which is directed in the opposite direction.

* * * * *